US008096002B2

(12) United States Patent
Stimpson et al.

(10) Patent No.: US 8,096,002 B2
(45) Date of Patent: Jan. 17, 2012

(54) HEIGHT ADJUSTABLE SHOWER WASTE

(75) Inventors: Robert William Stimpson, Douglas (GB); James Edward Self, Colby (GB)

(73) Assignee: DLP Limited, Isle of Man (GB)

( * ) Notice: Subject to any disclaimer, the term of this patent is extended or adjusted under 35 U.S.C. 154(b) by 637 days.

(21) Appl. No.: 12/303,655

(22) PCT Filed: Jun. 7, 2007

(86) PCT No.: PCT/GB2007/002090

§ 371 (c)(1),
(2), (4) Date: Dec. 5, 2008

(87) PCT Pub. No.: WO2008/009874

PCT Pub. Date: Jan. 24, 2008

(65) Prior Publication Data

US 2010/0235982 A1 Sep. 23, 2010

(30) Foreign Application Priority Data

Jul. 15, 2006 (GB) ..... 0614113.9

(51) Int. Cl.
*E03C 1/12* (2006.01)

(52) U.S. Cl. ..... 4/679; 4/693; 52/302.1; 52/20; 52/302.7; 210/163

(58) Field of Classification Search ..... 4/679, 695, 4/613; 210/163, 164, 166; 52/19, 20, 302.1, 52/302.6, 302.7
See application file for complete search history.

(56) References Cited

U.S. PATENT DOCUMENTS

| | | | | |
|---|---|---|---|---|
| 1,792,345 | A * | 2/1931 | Williams | 210/164 |
| 1,873,275 | A | 8/1932 | Boosey | |
| 3,036,401 | A * | 5/1962 | Stark | 248/188.4 |
| 4,694,513 | A | 9/1987 | Kiziah | |

(Continued)

FOREIGN PATENT DOCUMENTS

| | | |
|---|---|---|
| DE | 2803959 | 8/1979 |

(Continued)

OTHER PUBLICATIONS

International Search Report: Published: Jan. 24, 2008 of PCT/GB2007/002090 Filed: Jun. 7, 2007.

(Continued)

*Primary Examiner* — Brian Glessner
*Assistant Examiner* — Patrick Maestri
(74) *Attorney, Agent, or Firm* — Martin Fleit; Paul D. Bianco; Fleit Gibbons Gutman Bongini & Bianco PL

(57) ABSTRACT

A height-adjustable shower waste for a bathroom floor having a non-flexible waterproof floor covering material, the shower waste comprising a waste body (12) for mounting in the bathroom floor and having a base (20), one or more sides extending from the base (20), a waste water inlet (26), and a waste water outlet (30) connected or connectable to a drain; a cover support element (16) on which a cover element (18) is or can be provided to cover the waste water inlet (26); distance setting means (54, 66) for selectively setting a distance between an in use upper edge of the cover support element (16) and the waste body (12); and retaining means (90, 104) for positively retaining the cover support element (16) at the said set distance. A method and an adapter device are also provided.

13 Claims, 9 Drawing Sheets

U.S. PATENT DOCUMENTS

| | | | |
|---|---|---|---|
| 4,883,590 | A | 11/1989 | Papp |
| 6,269,495 | B1 | 8/2001 | Sondrup |

FOREIGN PATENT DOCUMENTS

| | | |
|---|---|---|
| EP | 0612893 | 8/1994 |
| GB | 920463 | 3/1963 |
| GB | 1014814 | 12/1965 |
| GB | 2421517 | 6/2006 |

OTHER PUBLICATIONS

Written Opinion of the International Searching Authority of PCT/GB2007/002090 Filed: Jun. 7, 2007.

British Search Report: Published Nov. 15, 2006.

International Preliminary Report on Patentability: Published: Jan. 20, 2009 of PCT/ GB2007/002090 Filed: Jun. 7, 2007.

* cited by examiner

HEIGHT ADJUSTABLE SHOWER WASTE

FIELD OF THE INVENTION

This invention relates to a height-adjustable shower waste and, more particularly but not exclusively, to a shower waste for clamping flexible waterproof floor covering material which can be adapted to provide a height-adjustable cover when used with non-flexible waterproof floor covering material, such as tiles.

BACKGROUND OF THE INVENTION

Height-adjustable interior floor wastes are known from Jay R Smith Mfg. Co. of Montgomery, Ala., USA. These provide a waste body which can be recessed into a floor and which is connectable to a drain, a grid cover for waste water to pass into the waste body, and a cover support which is screw-threadingly engaged with the waste body to enable height-adjustment of the grid cover relative to the waste body.

A height-adjustable shower or bathroom floor waste is also known from Impey UK Ltd of Ilton, Somerset, United Kingdom. This provides a waste body which is supported in a floor, a grid cover, and a cover support having a generally serrated or multi-ramped lower edge. Complementarily angled surfaces are provided on the waste body and on which the cover support sits. As the grid cover support is rotated in the waste body, the abutting ramp surfaces slide relative to each other, causing the cover support to telescopically extend or retract.

The problems associated with both of these arrangements is that, once the height of the cover has been adjusted and set, there is no means for preventing the height again changing, such as through use or by people inadvertently scuffing or knocking the cover grid.

Furthermore, the cover support of the Impey floor waste is not vertically engaged with the waste body, it is only seated in the waste body to slide on the ramped surfaces. Thus, the cover support is easily dislodged or removed from the waste body.

A further problem associated with the latter known arrangement is that, although the grid cover is removable from the cover support to permit access into the interior of the waste body, once the waste is installed, the height of the cover support from the base of the waste body can no longer be precisely adjusted and set rigidly in position prior to the flooring being installed. This follows from the fact that, when finishing the floor, either with concrete screed or tiles, the floor extends up to and abuts the cover support adjacent to the cover grid. Further height adjustment cannot reliably take place to compensate for changes in finished floor levels at the time of installation of the flooring material, typically tiles.

SUMMARY OF THE INVENTION

The present invention seeks to provide a solution to these problems.

According to a first aspect of the invention, there is provided a height-adjustable shower waste for a bathroom floor having a non-flexible waterproof floor covering material, the shower waste comprising a waste body for mounting in the bathroom floor and having a base, one or more sides extending from the base, a waste water inlet, and a waste water outlet connected or connectable to a drain; a cover support element on which a cover element is or can be provided to cover the waste water inlet; distance setting means for selectively setting a distance between an in use upper edge of the cover support element and the waste body; and retaining means for positively retaining the cover support element at the said set distance.

Preferable and/or optional features of the first aspect of the invention are set forth in claims 2 to 17, inclusive.

According to a second aspect of the invention, there is provided a method of installing a height-adjustable shower waste in accordance with the first aspect of the invention, the method comprising the steps of: a) locating the waste body in a floor; b) adjusting the height of the cover support element via the distance setting means so that an upper edge of the cover support element is in or substantially in the same plane as non-flexible waterproof floor covering material on the floor; c) using the retaining means to positively retain the cover support element at the set height; and d) laying non-flexible waterproof floor covering material up to or adjacent to a peripheral edge of the cover support element.

Preferably, in step (d), the non-flexible waterproof floor covering material prevents or limits access to the locking means.

According to a third aspect of the invention, there is provided a height-adjustable shower waste adaptor device for use in combination with a flexible waterproof floor covering shower waste to form a height-adjustable shower waste in accordance with the first aspect of the invention, the adaptor comprising a cover support element on which a cover element is or can be provided to cover the waste water inlet; an adaptor element for connection to the flexible waterproof floor covering shower waste and for supporting the cover support element; distance setting means for selectively setting a distance between an in use upper edge of the cover support element and the adaptor element; and retaining means for positively retaining the cover support element at the said set distance.

Such a waste hereinbefore so described may also beneficially be installed as part of a tanked floor installation which incorporates a painted or sprayed or similarly applied elastomeric or ruberiod compliant coating to present a secondary impermeable seal below a non-flexible waterproof flooring material.

BRIEF DESCRIPTION OF THE DRAWINGS

The present invention will now be more particularly described, by way of example only, with reference to the accompanying drawings, in which.

DETAILED DESCRIPTION OF THE INVENTION

Figure 1:
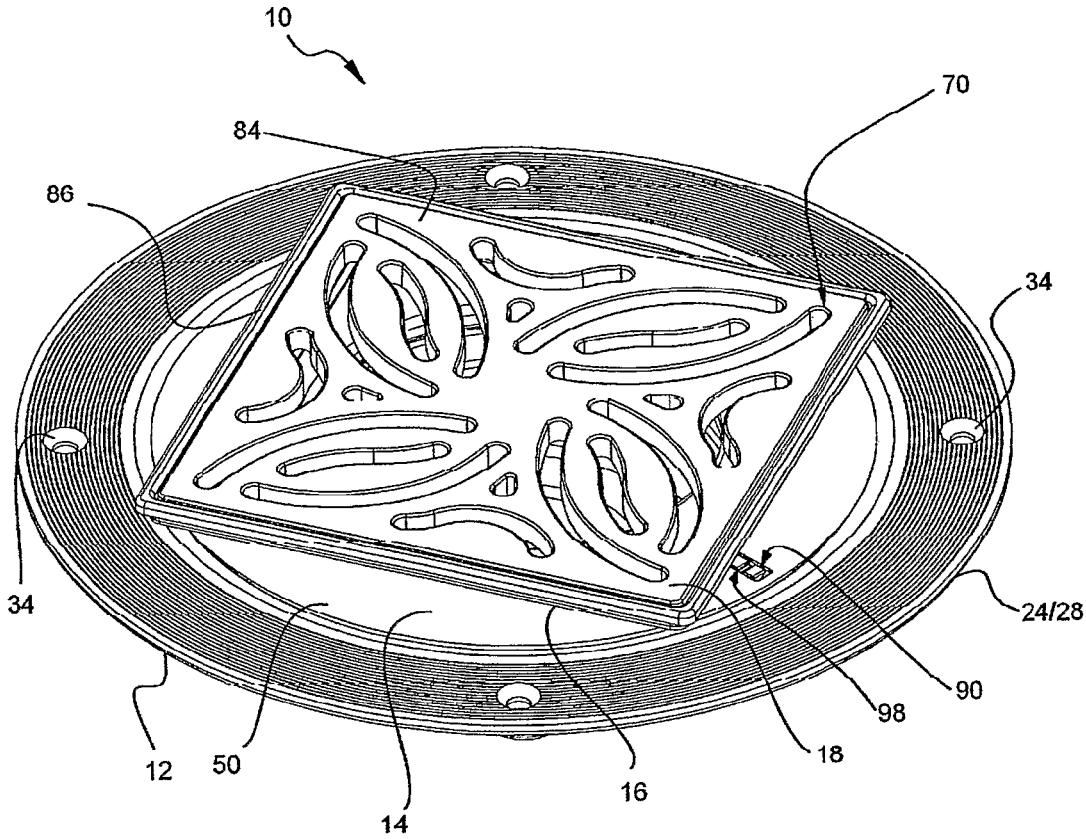
FIG. 1 is a perspective view of one embodiment of a height-adjustable shower waste, in accordance with the first aspect of the invention and which is in the form of a flexible waterproof floor covering shower waste adapted by use of an adjustable-height shower waste adaptor according to the third aspect of the invention.

Referring to the drawings, there is shown a height-adjustable shower waste 10 which comprises a waste body 12, a clamp ring adapter element 14, a cover support element 16 telescopically supported in the waste body 12, and a cover element 18 in the form of a grid and provided on the cover support element 16.

The waste body 12 is typically formed from moulded plastics material and has a base 20, a circular wall 22 extending in use upwardly from the base 20, an endless upper flange 24 formed to extend outwardly from a distal edge of the circular wall 22 in or substantially in parallel with and opposite to the base 20, a waste water inlet 26 opposite the base 20 and defined by an upper surface 28 of the waste body 12, and a waste water outlet 30 formed in the base 20 and opposite the waste water inlet 26. The circular wall 22 has a stepped interior surface 32 between the upper flange 24 and the base 20.

The upper flange 24 includes angularly spaced apertures 34 extending therethrough or guides for screw-threaded fasteners for fastening the waste body 12 to a floor surface.

The stepped interior surface 32 has an endless and unbroken frusto-conical clamping portion 36 which tapers in a converging direction away from the upper surface 28. An endless clamp support portion 38 extends radially inwardly and in parallel with the upper flange 24 from a lower edge of the frusto-conical clamping portion 36. The clamp support portion 38 includes a plurality of angularly spaced, typically threaded, recesses or apertures 40 for receiving screw-threaded fasteners 42.

An endless and unbroken frusto-conical sump portion 44 extends from a radially inner edge of the clamp support portion 38. The sump portion 44 tapers in a converging direction to meet the base 20.

The waste body 12 described above is adapted to enable clamping of, typically cold weldable, flexible waterproof floor covering material, such as Altro RTM. To this end, an endless clamp ring (not shown) can be provided. The clamp ring has an endless and unbroken frusto-conical clamping wall, and an endless engagement flange which projects radially inwardly from one edge of the clamping wall. The frusto-conical clamping wall tapers in a converging direction to meet the engagement flange, and angularly spaced openings or guides are provided on or through only the engagement flange to receive screw-threaded fasteners.

The dimensions of the clamp ring are such that the engagement flange can be seated on the clamp support portion 38, and engaged using screw-threaded fasteners 42 inserted in the openings or guides and engaged in the recesses or apertures 40 of the clamp support portion 38.

When seated on the clamp support portion 38, the clamping wall of the clamp ring extends in or substantially in parallel with, and is slightly spaced radially inwardly from, the clamping portion 36 of the waste body 12. Consequently, in use, the flexible floor covering material is cut to extend into the bore and along only the clamping portion 36. The clamp ring, when fastened to the clamp support portion 38, thus tightly clamps the flexible floor covering material to the clamping portion 36 of the waste body 12 via its clamping wall. The flexible floor covering material is not perforated, and thus no leak path is produced.

However, when it is desirable to use a non-flexible waterproof floor covering material, such as tiles, the clamp ring cannot be utilised.

Figure 2:
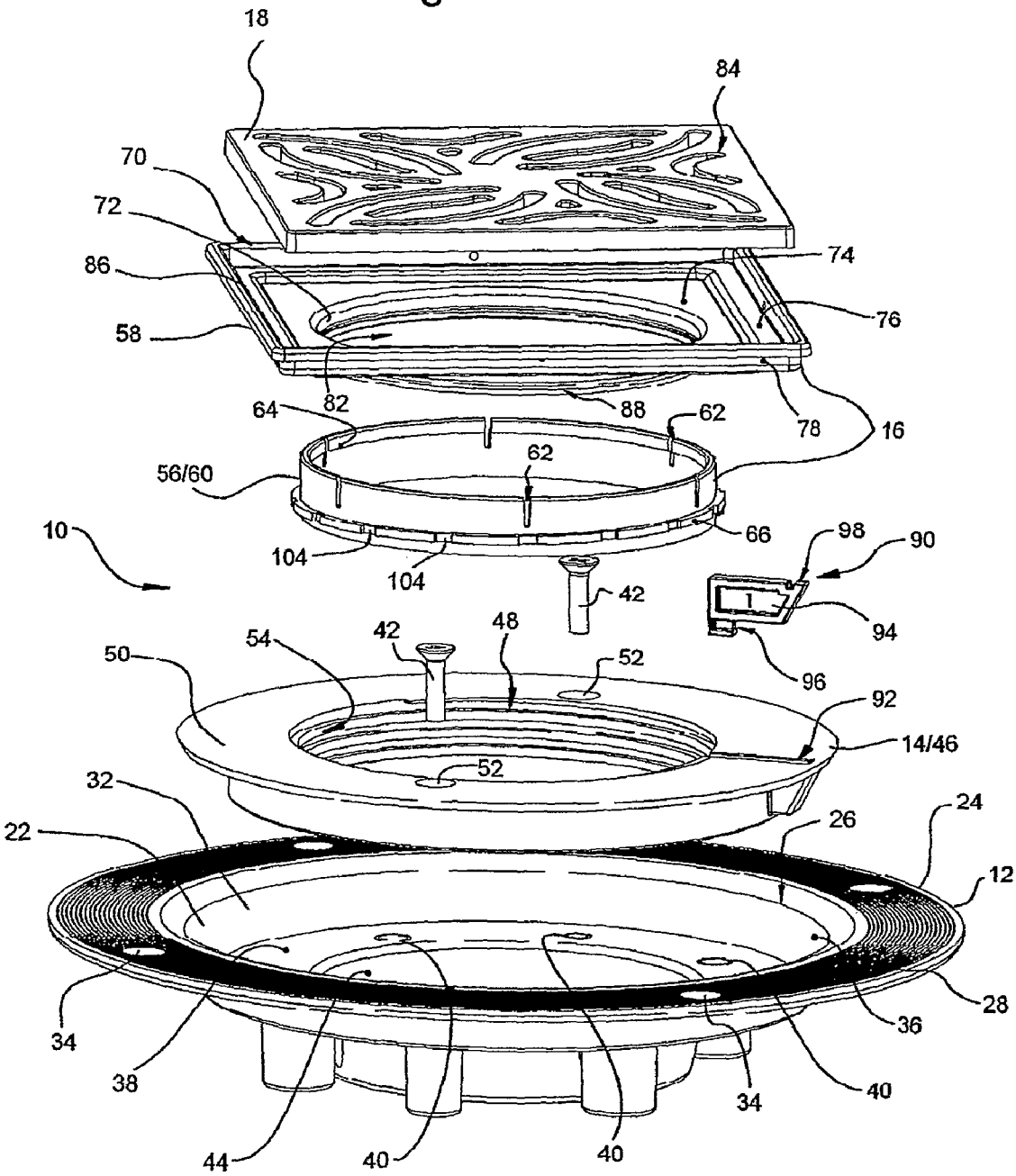
FIG. 2 is an exploded view of the waste shown in FIG. 1.

In this case, the clamp ring adapter element 14 is provided to replace the clamp ring. As best seen in FIG. 2, the adapter element 14 has an endless, typically plastics moulded, ring shaped generally cylindrical adapter body 46 defining a circular through-bore 48 through which waste water can flow, and an endless adapter flange 50 which extends radially outwardly from one edge of the adapter body 46. Diametrically opposed openings 52 are formed through the adapter body 46 in parallel with the through-bore 48 to receive screw-threaded fasteners 42.

A screw-thread 54, forming part of distance setting means for the cover support element 16, is integrally formed in the surface of the through-bore 48 of the adapter element 14, from one end to the other.

The adapter body 46 is dimensioned to sit on the clamp support portion 38 of the interior surface 32 of the waste body 12. When seated, the adapter flange 50 is coplanar or substantially coplanar with the upper flange 24 of the waste body 12. Screw-threaded fasteners 42 are located in the openings 52 of the adapter body 46, and received in the corresponding apertures or recesses 40 in the clamp support portion 38. In this way, the adapter body 46 can be securely engaged with waste body 12.

The cover support element 16 comprises an adapter engaging part 56 and a cover element support part 58. The engaging part 56 is typically formed from moulded plastics and has an endless ring-shaped cylindrical engaging body 60, axially extending slots 62 formed in an in use upper edge of the engaging body 60, an inwardly extending lip 64 formed on an inner surface of the engaging body 60 at or adjacent to the upper edge, and an arcuate rib 66 formed generally circumferentially on its outer surface, partway between the ends of the engaging body 60.

Figure 3:
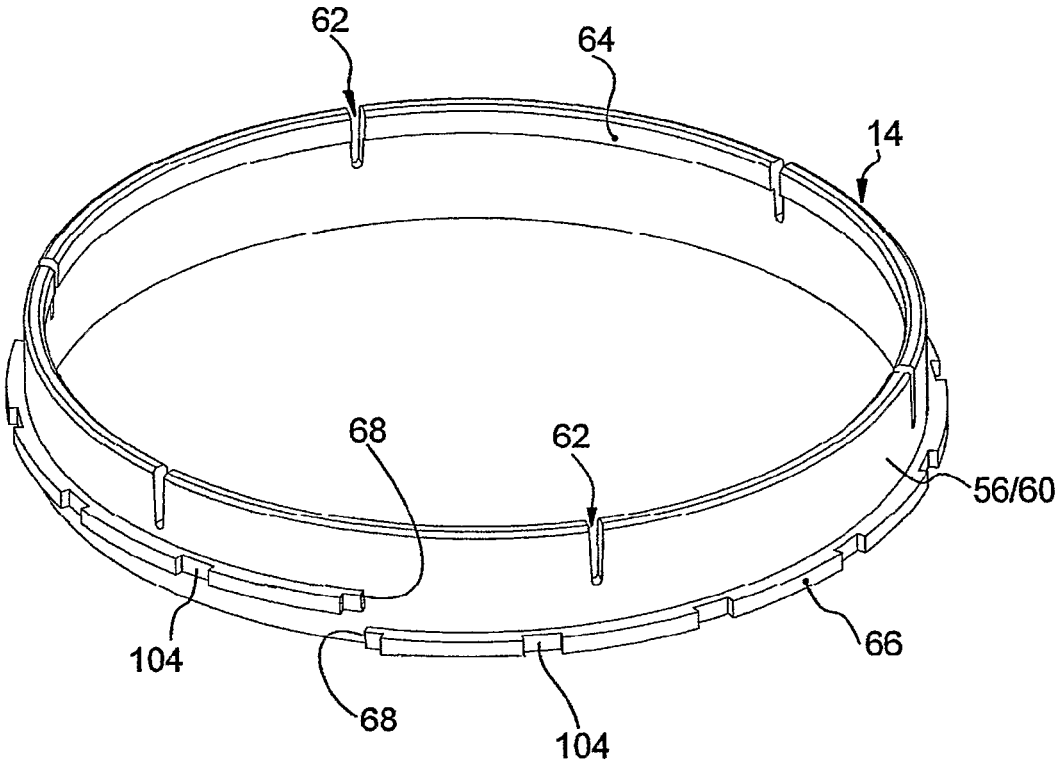
FIG. 3 is a perspective view of part of a cover support element shown in FIG. 2, but from another side.
Figure 4:
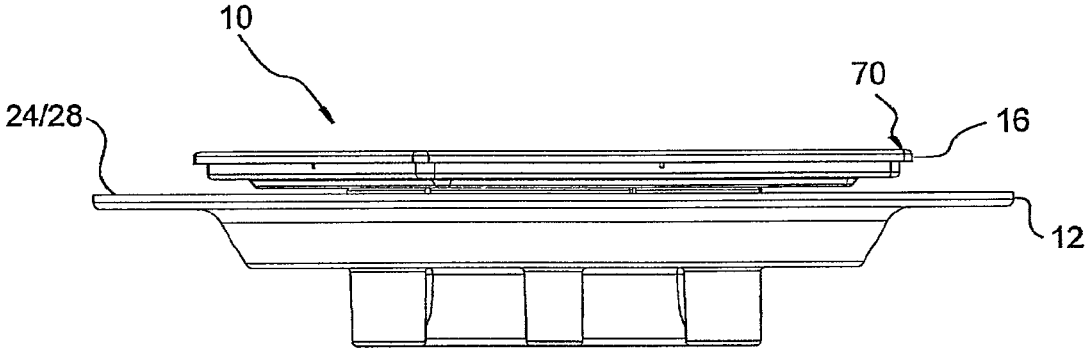
FIG. 4 is a side elevational view of the waste shown in FIG. 1.

The arcuate rib 66 forms another part of the distance setting means and projects radially outwardly from the outer surface of the engaging body 60. As understood from FIGS. 2 and 3, the arcuate rib 66 is not continuous, and the ends 68 are spaced in an axial direction of the engaging part 56 to provide a pitch which matches that of the screw-thread 54 formed in the through-bore 48 of the adapter element 14.

The arcuate rib 66 extends 360° around the engaging body 60, but may extend less than or more than 360°.

Although more complicated, the arcuate rib can be formed as multiple full and partial revolutions around the body 60.

The cover element support part 58 of the cover support element 16 is typically formed from metal or plastics material and includes a cover element tray 70 integrally formed with a cylindrical wall 72 which extends perpendicularly to the plane of the tray 70.

The tray 70 includes a recessed portion 74, a raised border 76 surrounding the recessed portion 74, and an upstanding edge 78 formed around the perimeter of the raised border 76. An endless outwardly projecting inverted U-shaped first lip 80 is formed to extend from the upstanding edge 78.

The recessed portion 74 of the tray 70 is formed with a central aperture 82, and the cylindrical wall 72 extends endlessly around the aperture from a lower surface of the recessed portion 74.

The upstanding edge 78 is dimensioned to removably accept the cover element 18 as a close fit. When supported by the tray 70, an upper surface 84 of the cover element 18 is coplanar or substantially coplanar with an upper surface 86 of the outwardly projecting first lip 80.

An endless outwardly projecting second lip 88 is formed at or adjacent to the distal end of the cylindrical wall 72, remote from the tray 70.

The adapter engaging part 56 and the cover element support part 58 are snap-fit engagable by pushing the cylindrical wall 72 into the cylindrical engaging body 60. The slots 62 allow the engaging body 60 to flex as the inwardly extending lip 64 of the engaging body 60 rides over the outwardly projecting second lip 88 of the cylindrical wall 72. Once connected, the engaging part 56 and the cover element support part 58 are tightly fastened relative to each other, making axial separation difficult, but not impossible. Furthermore, although relative angular displacement of the engaging part 56 and the cover element support part 58 is possible by hand, the engagement between the two parts is such that relative angular displacement can only occur when one part is forcibly restrained while the other part is rotated.

It will be understood that, when the engaging part 56 or the cover support element part 58 is subjected to only a rotating force which rotates one part relative to the other part, there is no relative axial displacement of the two parts.

Figure 5:
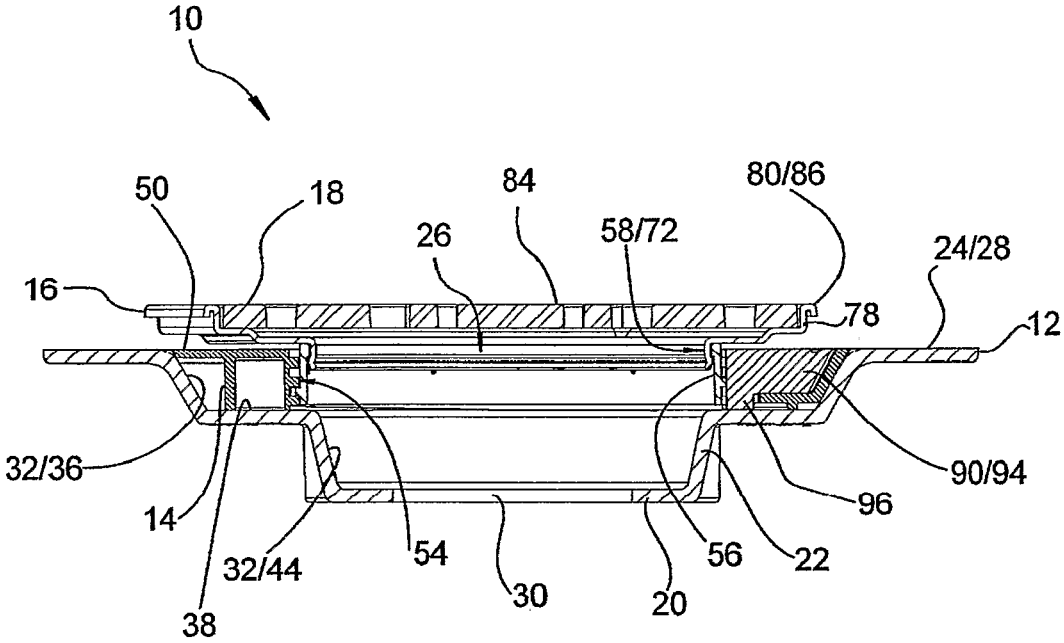
FIG. 5 is a cross-sectional view of the waste shown in FIG. 4.
Figure 7:
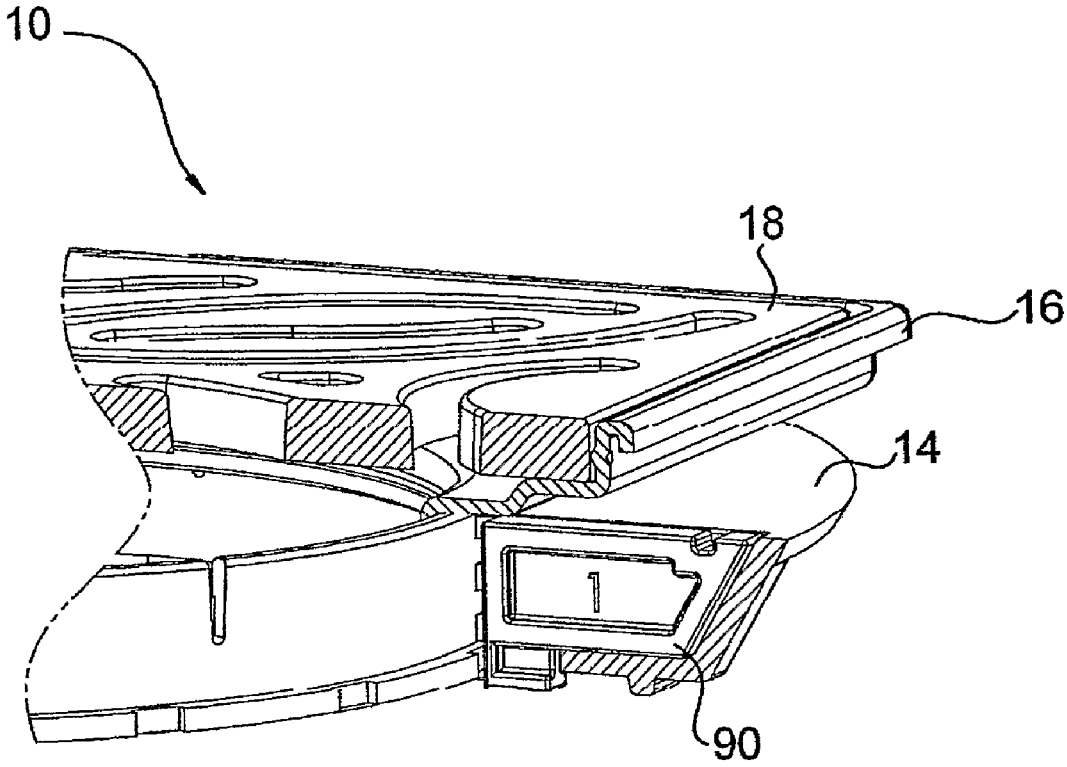
FIG. 7 is a view similar to FIG. 6, showing the tab element in a retracted condition.
Figure 8:
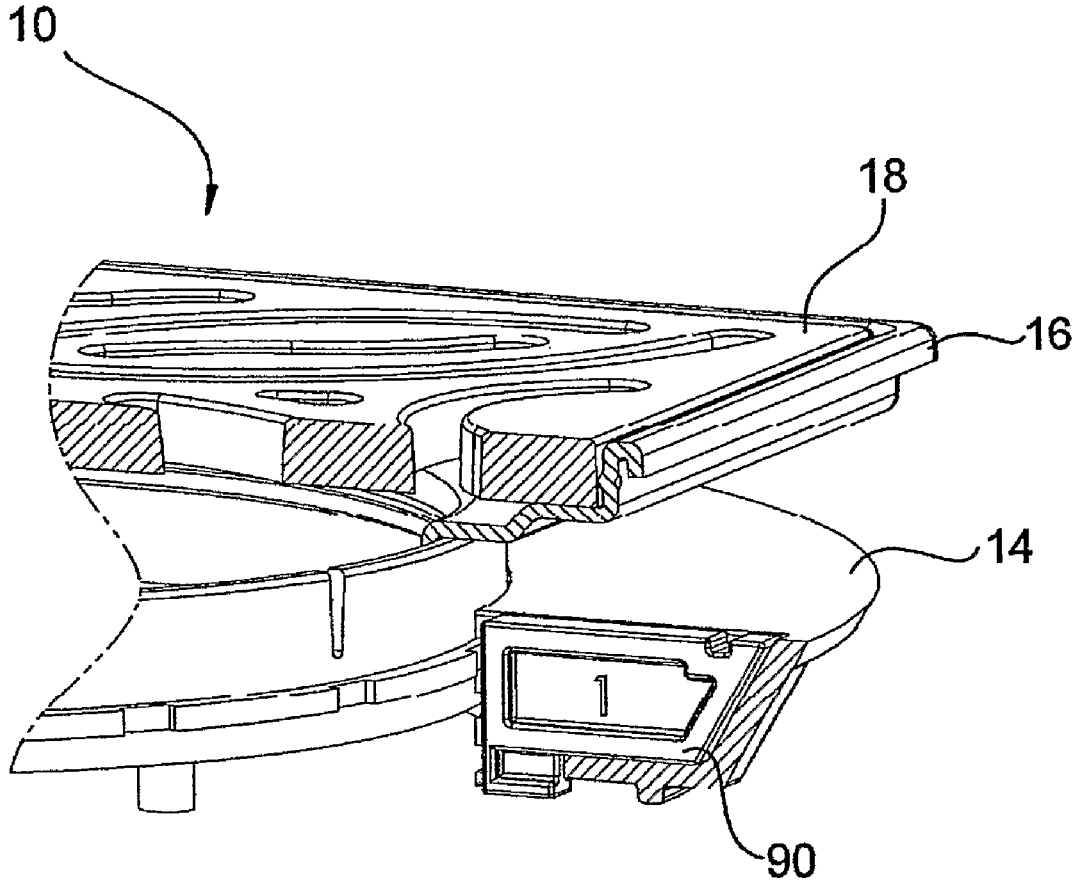
FIG. 8 is a view similar to FIGS. 6 and 7, showing the cover support element in a raised condition, with the tab element still retracted.

The cover support element 16 can thus be screw-threadingly engaged with the adapter element 14. The arcuate rib 66 projects outwardly to engage the screw-thread 54 (see FIG. 5) formed along the through-bore 48 of the adapter body 46. As the cover support element 16 is rotated, the arcuate rib 66 moves along the screw-thread 54 (FIGS. 7 and 8), thus causing the tray 70 of the cover support element 16, and consequently the cover element 18 when provided thereon, to move towards or away from the adapter element 14.

Retaining means is provided to releasably retain the cover support element 16 at a selected position relative to the adapter element 14. The retaining means comprises a tab element 90 which is slidably received in a tab slot 92 formed in the adapter body 46 and adapter flange 50. The tab slot 92 extends from the bore of the adapter element 14 and radially outwards along the adapter flange 50, terminating prior to the perimeter edge of the adapter flange 50.

The tab element 90 is generally pistol-shaped having a tab body 94, a runner 96 depending from an in use lower edge of the tab body 94, and a tab notch 98 formed in an upper edge opposite the lower edge. A runner slot 100 is formed in the base of the tab slot 92 to slidably receive a reduced thickness web portion 102 of the runner 96. The tab notch 98 is accessible from the adapter flange 50 to move the tab element 90 radially into and out of the through-bore 48 of the adapter element 14 (FIGS. 6 to 9).

Although not biased, the tab element 90 can be biased, for example via a spring element, to project into the through-bore 48 of the adapter element 14.

The retaining means also includes a plurality of tab element recesses 104 formed at preferably, but not necessarily, equi-angularly spaced intervals along the longitudinal extent of the arcuate rib 66 of the cover support element 16. The tab element recesses 104 are spaced to allow a variation in distance from the cover element 18, when provided on the tray 70 of the cover support element 16, to the upper flange 24 of the waste body 12 of between 4 mm to 16 mm. This range is suggested, since this accommodates all common thicknesses of ceramic tile. However, other distances are entirely feasible.

Figure 6:
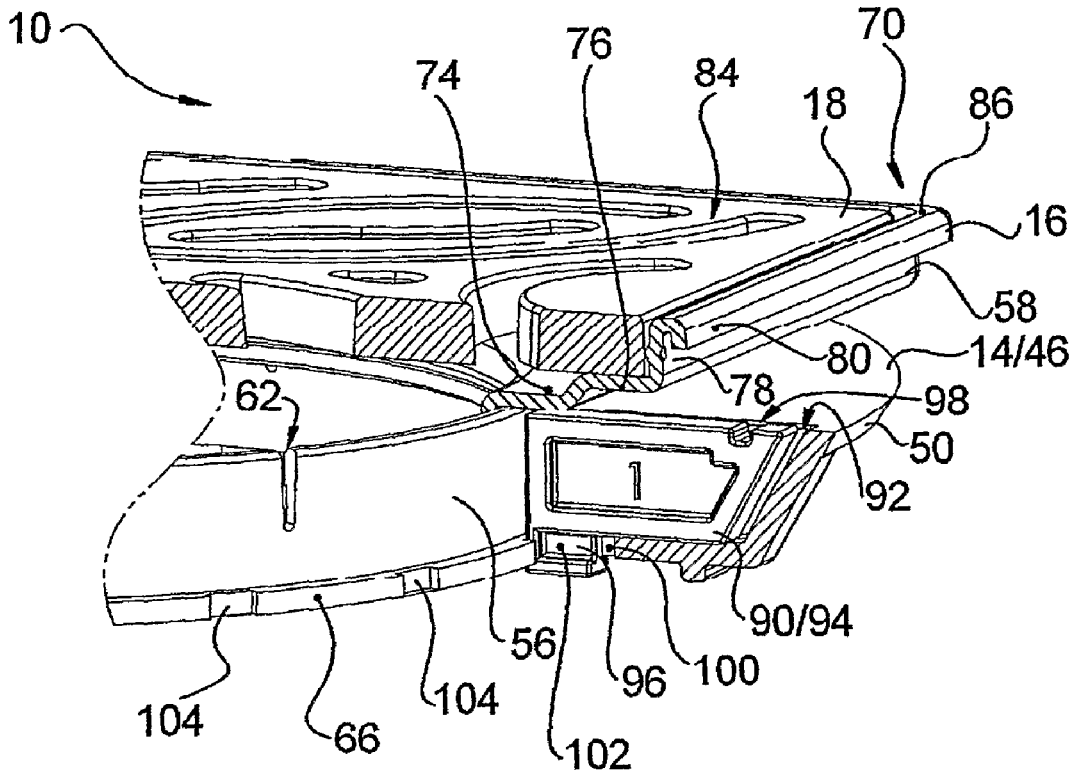
FIG. 6 is a partially sectioned, enlarged scrap view showing the cover support element, cover element, and a tab element of retaining means of the waste and adaptor.
Figure 9:
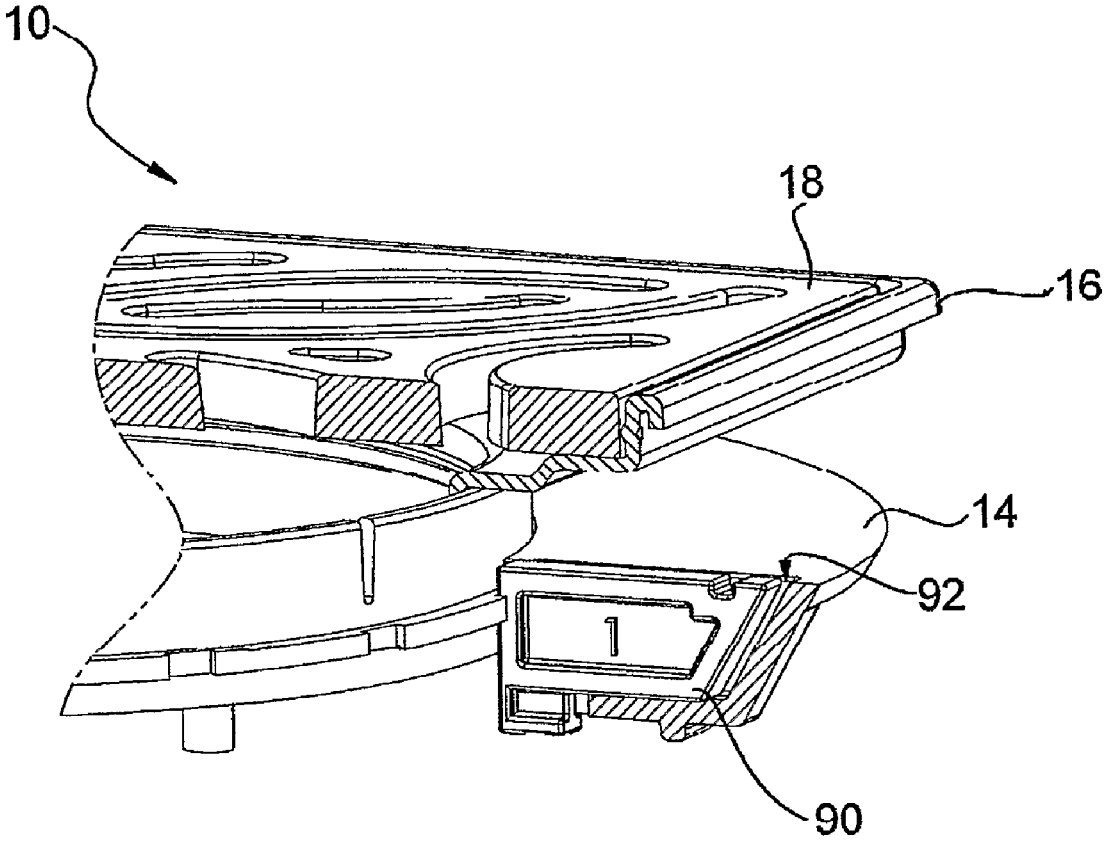
FIG. 9 is a view similar to FIGS. 6 to 8, showing the tab element in a projecting condition and locking the cover support element.

The tab element recesses 104 are dimensioned to receive a radially inner edge of the in use tab element 90, as can be seen in FIGS. 6 and 9.

In use, once it has been determined where the waste should be sited, the waste body 12 is recessed into the existing floor, ideally located in a wet floor former as typified in GB2401341A or by making a suitably sized hole in concrete flooring or by removing portions of floorboards. The waste water outlet 30 of the waste body 12 is connected to the drain, optionally via a pump.

It will be evident to those skilled in the art that the arrangement of waste body 12, flange 24 and frusto-conical clamping portion 36 and the associated support surface 38 describes known prior art used extensively in flexible wet floor material clamp type waste drains of a wide variety of types. Accordingly, the single example of a waste with a simple outlet 30 so described to accommodate the present invention is understood to include all derivatives of such waste discharges which may optionally include stench water traps or be of the pumped waste arrangement without detracting from the uniqueness of said invention.

The clamp ring is dispensed with, and the adapter element 14 is fastened in the waste water inlet 26 of the waste body 12 via screw-threaded fasteners, as described above. The tab element 90 is inserted into the tab slot 92, in a retracted condition. The adapter engaging part 56 and the cover element support part 58 of the cover support element 16 are snap-fittably engaged, again as described above, and the cover support element 16 is then screw-threadingly engaged in the through-bore 48 of the adapter element 14 by winding the arcuate rib 66 along the screw-thread 54 of the adapter element 14.

Waterproof non-flexible floor covering material, such as tiles, is then positioned on the floor adjacent to the waste 10. The plane of the upper surface of the non-flexible floor covering material is determined, and the cover support element 16 is rotated (FIGS. 7 and 8) until the outwardly extending first lip 80 on the cover support element 16 becomes coplanar or substantially coplanar.

Once the distance of the tray 70 of the cover support element 16, and thus the cover element 18 itself, from the waste body 12 has been set, the tab element 90 is urged via the tab notch 98 to project into the through-bore 48 of the adapter element 14 and to engage in one of the tab element recesses 104 on the arcuate rib 66 of the cover support element 16 (FIG. 9). The cover support element 16 is thus locked or retained in position, and as such is prevented from further moving vertically relative to the waste body 12.

The cover element support part 58, however, can, with some effort, still be angularly rotated to simplify alignment with the non-flexible floor covering material.

Once the tab element 90 locks the cover support element 16, the non-flexible floor covering material is extended up to and under the outwardly extending first lip 80 of the tray 70, thus covering the tab element 90, as will be understood from FIG. 1.

The cover element 18 can then be placed in the tray 70. Since the cover element 18 is a grid, waste water will run across the non-flexible floor covering material and enter the waste body 12 through the cover element 18 and the cover support element 16.

In a modification, for an existing flexible waterproof floor covering shower waste, already installed, the clamp ring adaptor element, the cover support element, and a cover element can be provided as a height-adjustable shower waste adaptor device for use in combination with the waste body of the flexible waterproof floor covering shower waste. This easily enables a height-adjustable shower waste to be provided without requiring complete removal and reinstallation of the existing waste. The existing flexible waterproof floor covering material can then be replaced with non-flexible waterproof floor covering material.

Although the above embodiments have been described with reference to an adaptor element for adapting an existing flexible waterproof floor covering shower waste, the shower waste can be produced solely as a height-adjustable device. In this case, the adaptor element is dispensed with and an interior surface at or adjacent to the waste water inlet of the waste body is integrally formed with the screw-thread. The cover support element is thus directly screw-threadingly engaged with the waste body, rather than being indirectly engaged via the adaptor element.

If the vertical height of the cover element does need to be adjusted following installation, for example, due to settling, the tab element is accessed and retracted, the cover element is lifted out of the tray, and, by reaching inside, the adaptor element engaging part can be rotated to lift or lower the cover element support part relative to the waste body and the surrounding floor surface. In this way, only a small portion of the non-flexible floor covering material need be removed to access the tab element, since the cover element support part need not be rotated in order to achieve vertical displacement.

The cover element could be formed without apertures. In this case, waste water flows into the waste body through a gap provided between the perimeter edge of the cover element and the cover support element.

The waste water outlet can be formed in the wall of the bore, rather than in the base.

Although the non-flexible waterproof floor covering material can be positioned up to the edge of the cover support element, it may only be adjacent to the edge with grouting or other suitable filler being used to bridge a small gap or gaps therebetween.

The wall of the waste body is circular, but may be non-circular and can includes more than one contiguous wall or side.

Although the arcuate rib is provided on the cover support element, it could of course be provided on the waste body. In this case, the screw-thread is provided on the waste body or clamp ring adaptor element. With this arrangement, the tab element can be provided on the cover support element, and the tab element recesses can be provided on the waste body.

The arcuate rib is the sole arcuate rib. However, two or more arcuate ribs can be provided in axially spaced relationship.

Furthermore, a plurality of arcuate ribs can be provided in spaced relationship in the longitudinal direction of the ribs. For example, the tab element recesses can be provided as spaces between the plurality of arcuate ribs, such that the arcuate ribs are spaced from each other.

The tab element is slidably movable. However, other kinds of tab element are envisaged, such as a rotatable or pivotable tab element which is movable by angular displacement to engage or disengage the cover support element and/or the waste body or clamp ring adaptor element.

Although a tab element and tab recesses are suggested, any suitable combination of locking element or elements on the one part and locking recess or recesses on the other part can be utilised.

The cover support element is a two part element. However, the cover support element can be formed as a single part.

The cover support element can include more than two parts, whereby spacer elements are provided for interposable engagement between the adapter engaging part and the cover element support part in order to provide additional provision to further vary the height of the tray above the waste body.

It is thus possible to provide a shower waste with a cover which is height-adjustable. It is also possible to provide a shower waste which prevents or limits further vertical height-adjustment or vertical movement once the height has been set. A cover support element can be provided which does allow relative angular displacement of the cover, even when the height has been set and locked. It is also possible to provide an adaptor device which can adapt an existing flexible wet-floor clamping shower waste for use with a non-flexible floor covering, so as to provide an adjustable-height cover.

The embodiments described above are given by way of examples only, and various other modifications will be apparent to persons skilled in the art without departing from the scope of the invention, as defined by the appended claims.

The invention claimed is:

1. A height-adjustable shower waste for a bathroom floor having a non-flexible waterproof floor covering material, the shower waste comprising:

a waste body (12) for mounting in the bathroom floor and having a base (20), one or more sides extending from the base (20), a waste water inlet (26), and a waste water outlet (30) connected or connectable to a drain;

a cover support element (16) on which a cover element (18) is configured to cover the waste water inlet (26);

distance setting means (54, 66) for selectively setting a distance between an in use upper edge of the cover support element (16) and the waste body (12), the distance setting means comprising an arcuate rib (66) which is provided on one of the cover support element (16) and waste body (12), and a screw-thread (54) on the other one of the cover support element (16) and the waste body (12), the arcuate rib (66) being movable along the screw-thread to alter the distance between the upper edge of the support element (16) and the waste body (12); and retaining means (90, 104) for positively retaining the cover support element (16) at the said set distance, said retaining means comprising at least one locking tab (90) which is provided on one of the waste body (12) and the cover support element (16) and which is movable between a locked position at which the distance between the cover element (18) and the base (20) of the waste body is fixed, and an unlocked position at which the distance between the cover element (18) and the base (20) of the waste body is adjustable, and a plurality of spaced recesses (104) which are provided on the other one of the waste body (12) and the cover support element (16) and in which the locking tab (90) is receivable to hold the cover support element (16) at a fixed distance from the base (20) of the waste body.

2. A height-adjustable shower waste as claimed in claim 1, wherein the arcuate rib (66) is the sole arcuate rib (66).

3. A height-adjustable shower waste as claimed in claim 1, wherein the arcuate rib (66) is discontinuous.

4. A height-adjustable shower waste as claimed in claim 1, wherein the arcuate rib (66) extends less than 360 degrees.

5. A height-adjustable shower waste as claimed in claim 1, wherein the arcuate rib (66) is continuous.

6. A height-adjustable shower waste as claimed in claim 1, wherein the cover support element (16) comprises first and second cover support parts (58, 56) which are angularly displaceable relative to each other, the cover element (18) being provided on the first part (58) and part of the distance setting means being provided on the second part (56).

7. A height-adjustable shower waste as claimed in claim 1, wherein the waste body (12) includes a clamping surface (36) for clamping flexible waterproof floor covering material to the waste body (12), and an adapter element (14) which is fastenable to the clamping surface (36), part of the distance setting means being provided on the adapter element (14).

8. A height-adjustable shower waste as claimed in claim 7, wherein the clamping surface (36) is frusto-conical.

9. A height-adjustable shower waste as claimed in claim 1, wherein the tab element (90) is slidable between the locked and unlocked positions.

10. A height-adjustable shower waste as claimed in claim 1, wherein the tab element (90) is supported by the waste body (12), and the tab recesses (104) are provided on the waste body (12) or part of the distance setting means.

11. A height-adjustable shower waste as claimed in claim 10, wherein the tab element (90) is movable to project into the waste water inlet (26) of the waste body (12).

12. A height-adjustable shower waste as claimed in claim 1, in the form of a kit of parts.

13. A height-adjustable shower waste adapter device for use in combination with a flexible waterproof floor covering shower waste to form a height-adjustable shower waste, the adapter comprising:

a cover support element (16) on which a cover element (18) is or can be provided to cover the waste water inlet (26);

an adapter element (14) for connection to the flexible waterproof floor covering shower waste and for supporting the cover support element (16);

distance setting means (54, 66) for selectively setting a distance between an in use upper edge of the cover support element (16) and the adapter element (14), the distance setting means comprising an arcuate rib (66) which is provided on one of the cover support element (16) and the adapter element (14), and a screw-thread (54) on the other one of the cover support element (16) and the adapter element (14), the arcuate rib (66) being movable along the screw-thread to alter the distance between the upper edge of the support element (16) and the adapter element (14); and retaining means (90, 104) for positively retaining the cover support element (16) at the said set distance, said retaining means comprising at least one locking tab (90) which is provided on one of the cover support element (16) and the adapter element (14) and which is movable between a locked position at which the distance between the cover element (18) and the adapter element (14) is fixed, and an unlocked position at which the distance between the cover element (18) and the adapter element (14) is adjustable, and a plurality of spaced recesses (104) which are provided on the other one of the cover support element (16) and the adapter element and in which the locking tab (90) is receivable to hold the upper edge of the cover support element (16) at a fixed distance from the adapter element.

* * * * *